US009188074B2

(12) United States Patent
Cheever, Jr. et al.

(10) Patent No.: US 9,188,074 B2
(45) Date of Patent: Nov. 17, 2015

(54) FUEL INJECTOR CONTROL SYSTEM AND COMPONENT FOR PIECEWISE INJECTOR SIGNAL GENERATION

(71) Applicant: DELPHI TECHNOLOGIES, INC., Troy, MI (US)

(72) Inventors: Gordon D. Cheever, Jr., Peru (IN); Daniel C. Penrod, Russiaville, IA (US)

(73) Assignee: DELPHI TECHNOLOGIES, INC., Troy, MI (US)

( * ) Notice: Subject to any disclaimer, the term of this patent is extended or adjusted under 35 U.S.C. 154(b) by 564 days.

(21) Appl. No.: 13/691,956

(22) Filed: Dec. 3, 2012

(65) Prior Publication Data

US 2014/0150751 A1 Jun. 5, 2014

(51) Int. Cl.
*F02D 41/20* (2006.01)
*F02D 41/14* (2006.01)

(52) U.S. Cl.
CPC ..... *F02D 41/20* (2013.01); *F02D 2041/1411* (2013.01); *F02D 2041/2003* (2013.01); *F02D 2041/2044* (2013.01); *F02D 2250/12* (2013.01)

(58) Field of Classification Search
CPC .. F02D 41/20; F02D 41/1411; F02D 2250/12
See application file for complete search history.

(56) References Cited

U.S. PATENT DOCUMENTS

| | | | | |
|---|---|---|---|---|
| 4,064,423 | A | 12/1977 | Atkisson, Jr. | |
| 5,430,601 | A * | 7/1995 | Burcham | 123/490 |
| 2014/0043000 | A1 | 2/2014 | Bojarski et al. | |

FOREIGN PATENT DOCUMENTS

| | | | |
|---|---|---|---|
| DE | 10 2007 042995 | A1 | 3/2009 |
| EP | 1 426 597 | A1 | 6/2004 |
| EP | 2 484 885 | A1 | 8/2012 |
| WO | 2012/088130 | A2 | 6/2012 |

OTHER PUBLICATIONS

European Search Report dated Jun. 11, 2015.

* cited by examiner

*Primary Examiner* — Hieu T Vo
(74) *Attorney, Agent, or Firm* — Lawrence D. Hazelton

(57) ABSTRACT

A system and component for generating a drive signal suitable to operate a fuel injector. The drive signal includes one or more injector pulses. Each injector pulse is characterized by a desired pulse profile. The system includes an injector driver and a controller. The injector driver is operable to apply a supply voltage to the fuel injector. The controller is configured to store a plurality of state definitions that determine an operation state of the injector driver when a selected definition of the plurality of state definitions is communicated to the injector driver. The controller is further configured to receive a sequence of state values that determine an order that the state definitions are communicated to the injector driver to generate piecewise an injector pulse exhibiting the pulse profile, and thereby generate the drive signal.

19 Claims, 6 Drawing Sheets

30

GENERIC STATE DEFINITION

| |
|---|
| STATE ID -- 5 bits |
| STATE DURATION -- 16 bits (100 ns/bit, 0-6.5535 ms) |
| MODE CONTROL -- 2 bits |
| LS ENABLE --1 bit |
| LVHS ENABLE -- 1 bit |
| HVHS ENABLE -- 1 bit |
| PWM PERIOD -- 8 bits |
| CURRENT MIN/PWM DUTY CYCLE -- 8 bits (0.1A/bit, 0-25.5A range |
| CURRENT MAX -- 8 bits (0.1A/bit, 0-25.5A range) |
| LOOP BACK -- 3 bits |

FIG. 3

FUEL INJECTOR CONTROL SYSTEM AND COMPONENT FOR PIECEWISE INJECTOR SIGNAL GENERATION

TECHNICAL FIELD OF INVENTION

This disclosure generally relates to operating a fuel injector, and more particularly relates to a component configured to generate piecewise, one or more injector pulses to output a drive signal that operates the fuel injector.

BACKGROUND OF INVENTION

It is desirable to control current and voltage applied to a fuel injector solenoid of an engine. For example, a boosted voltage of fifty to sixty-five Volts (50V-65V) may be applied to open the injector quickly, and then a lower voltage of ten to sixteen Volts (10V-16V) may be used to control injector current to keep the injector open. In order to meet future reduced engine emission regulations, more advanced and flexible injector current control techniques are required. For example, an initial low current level (e.g. pre-charge) may be applied prior to injector opening to reduce the opening time and the amount of boost energy required. Intermediate current levels between peak and hold may also be used. Some applications vary the injector current levels depending upon vehicle or engine conditions such as the available system voltage, estimated cylinder pressure, or angle of injection. Gaseous fuel injectors require additional control pulses to reduce the closing forces. Similar requirements are present for high-pressure fuel pump solenoids. All of these advanced control techniques require the ability to easily define and vary the solenoid control waveforms.

Existing solutions typically require constant intervention by a microprocessor to update the desired solenoid control voltages and currents. If multiple fuel pulses per cylinder event are needed, updating control parameters between these pulses places an undue throughput burden on the microprocessor and may not even be feasible due to timing constraints.

SUMMARY OF THE INVENTION

In accordance with one embodiment, a system for generating a drive signal suitable to operate a fuel injector is provided. The drive signal includes one or more injector pulses, each injector pulse having a pulse profile. The system includes an injector driver and a controller. The injector driver is operable to apply a supply voltage to the fuel injector. The controller is configured to operate the injector driver in a manner effective to generate the drive signal. The controller is also configured to store a plurality of state definitions that determine an operation state of the injector driver when a selected definition of the plurality of state definitions is communicated to the injector driver. The controller is further configured to receive a sequence of state values that determine an order that the state definitions are communicated to the injector driver to generate piecewise an injector pulse exhibiting the pulse profile, and thereby generate the drive signal.

In another embodiment, an electrical component for operating an injector driver operable to apply a supply voltage to a fuel injector and generate a drive signal suitable to operate the fuel injector is provided. The drive signal includes one or more injector pulses, each injector pulse having a pulse profile. The component includes a controller configured to operate the injector driver in a manner effective to generate the drive signal. The controller is configured to store a plurality of state definitions that determine an operation state of the injector driver when a selected definition of the plurality of state definitions is communicated to the injector driver. The controller is further configured to receive a sequence of state values that determine an order that the state definitions are communicated to the injector driver to generate piecewise an injector pulse exhibiting the pulse profile, and thereby generate the drive signal.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which:

FIG. 3 is a table of variables included in a state definition used in the system of FIG. 1 in accordance with one embodiment;

DETAILED DESCRIPTION

Figure 1:
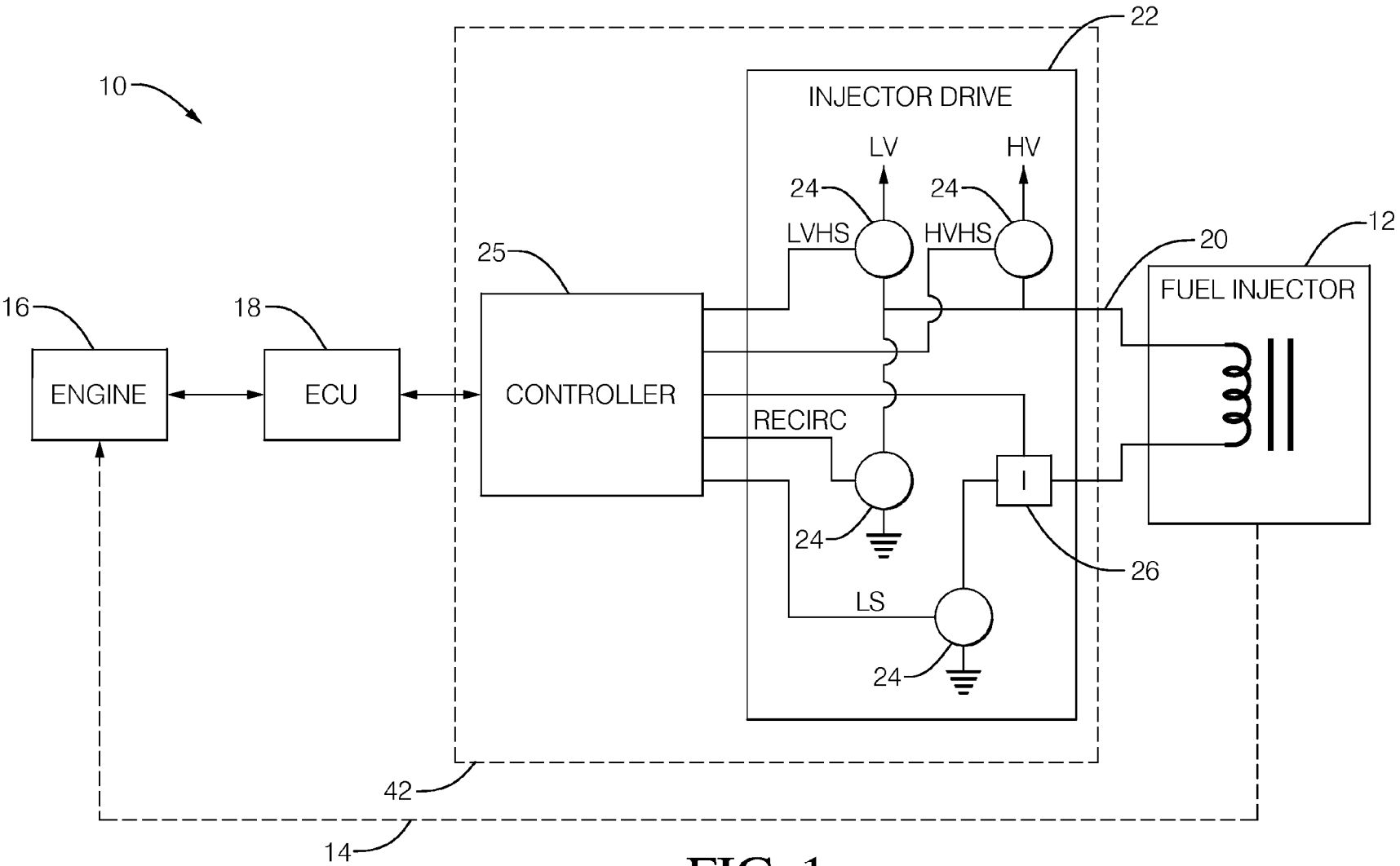
FIG. 1 is a diagram of a fuel injector control system in accordance with one embodiment.

FIG. 1 illustrates a non-limiting example of a system 10 for generating a drive signal 20 suitable to operate a fuel injector 12 to control the delivery of fuel 14 to an engine 16. A single fuel injector is illustrated only for the purpose of simplifying the explanation, and it is recognized that the teaching set forth herein is applicable to multiple cylinder engines with multiple fuel injectors, for example one fuel injector per cylinder of a six-cylinder engine. It is known to be advantageous to cycle the fuel injector 12 on and off multiple times during a single combustion cycle of a cylinder to distribute more optimally the fuel 14 within a combustion chamber of the engine 16. As such, it is typical for the drive signal 20 to comprise one or more injector pulses during a single combustion cycle, and each injector pulse included in the drive signal 20 may have a distinct pulse profile.

In general, the system 10 may include an injector driver 22 operable to apply a supply voltage to the fuel injector 12. The supply voltage applied may not be limited to a single voltage value. For example, the supply voltage may include a low-voltage source (LV) of fourteen volts (14V), and a high-voltage source (HV) of sixty-five volts (65V). The injector driver 22 may include a plurality of switches 24 configured to connect and disconnect the fuel injector 12 to the various voltage supplies. The switches 24 may each be, for example, a metal-oxide-semiconductor-field-effect-transistor (MOSFET) or an insulated-gate-bipolar-transistor (IGBT). The injector driver 22 may also include a current sensor 26 configured to measure injector current. The configuration shown is one example of several potential configurations of injector drivers suitable for use in the system 10 described herein.

The system 10 may also include a controller 25 configured to operate the injector driver 22 in a manner effective to generate the drive signal 20. In this example, the controller 25 is configured to output switch control signals to the switches 24, and receive a current signal from the current sensor 26. The switch control signals may include a low-voltage high side signal (LVHS); a high-voltage high side signal (HVHS); a recirculation control signal (RECIRC) to manage any residual current stored in the coil of the fuel injector 12 when the other switches are turned off; and a low side control signal (LS) for controlling the connection of the fuel injector 12 to ground. The controller may receive signals from an engine control unit, hereafter the ECU 18, that are based on various signals from the engine 16, and signals from other sources (not shown) such as an accelerator pedal (not shown) being pressed by an operator (not shown) to indicate how much acceleration is desired by the operator.

Figure 2:
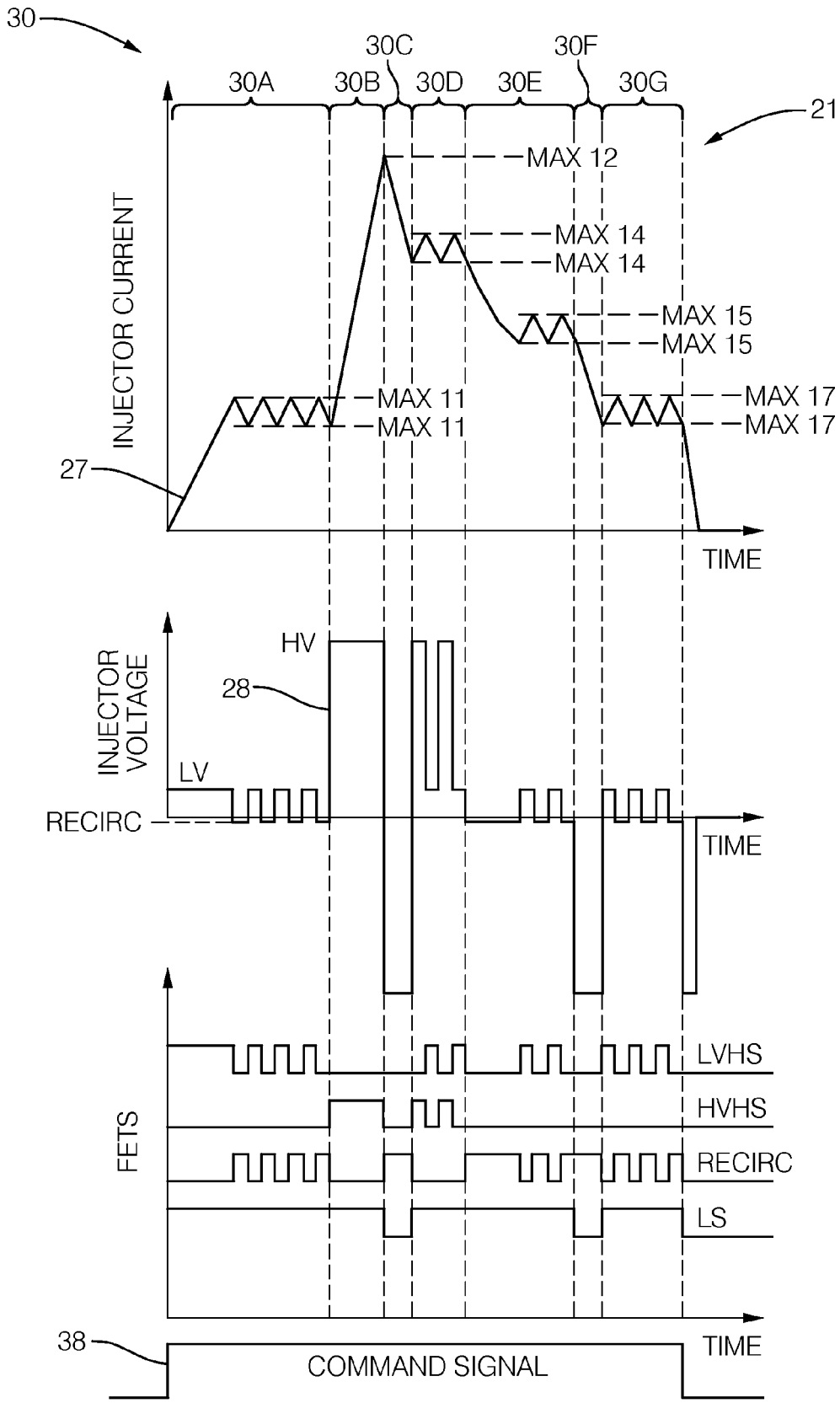
FIG. 2 is a diagram of an injector pulse generated by an injector driver, and control signals for the injector driver of FIG. 1 in accordance with one embodiment.

FIG. 2 illustrates a non-limiting example of an injector pulse 21 of the drive signal 20 having a pulse profile characterized by both injector current 27 and injector voltage 28. As will be described in more detail below, the injector pulse 21 is generated or constructed in a piecewise manner by operating the injector driver 22 in accordance with a sequence of state definitions 30 (30A, 30B, 30C, 30D, 30E, 30F, and 30G) to generate the drive signal 20. In this example, some of the state definitions include defined minimum and maximum current values (e.g. Min I 1, Max I 1, Min I 4, Max I 4, etc.) that are used by the controller 25 to modulate voltage applied to the fuel injector 12 to control current through the fuel injector 12 to some range between the specified minimum and maximum current values.

Figure 4:
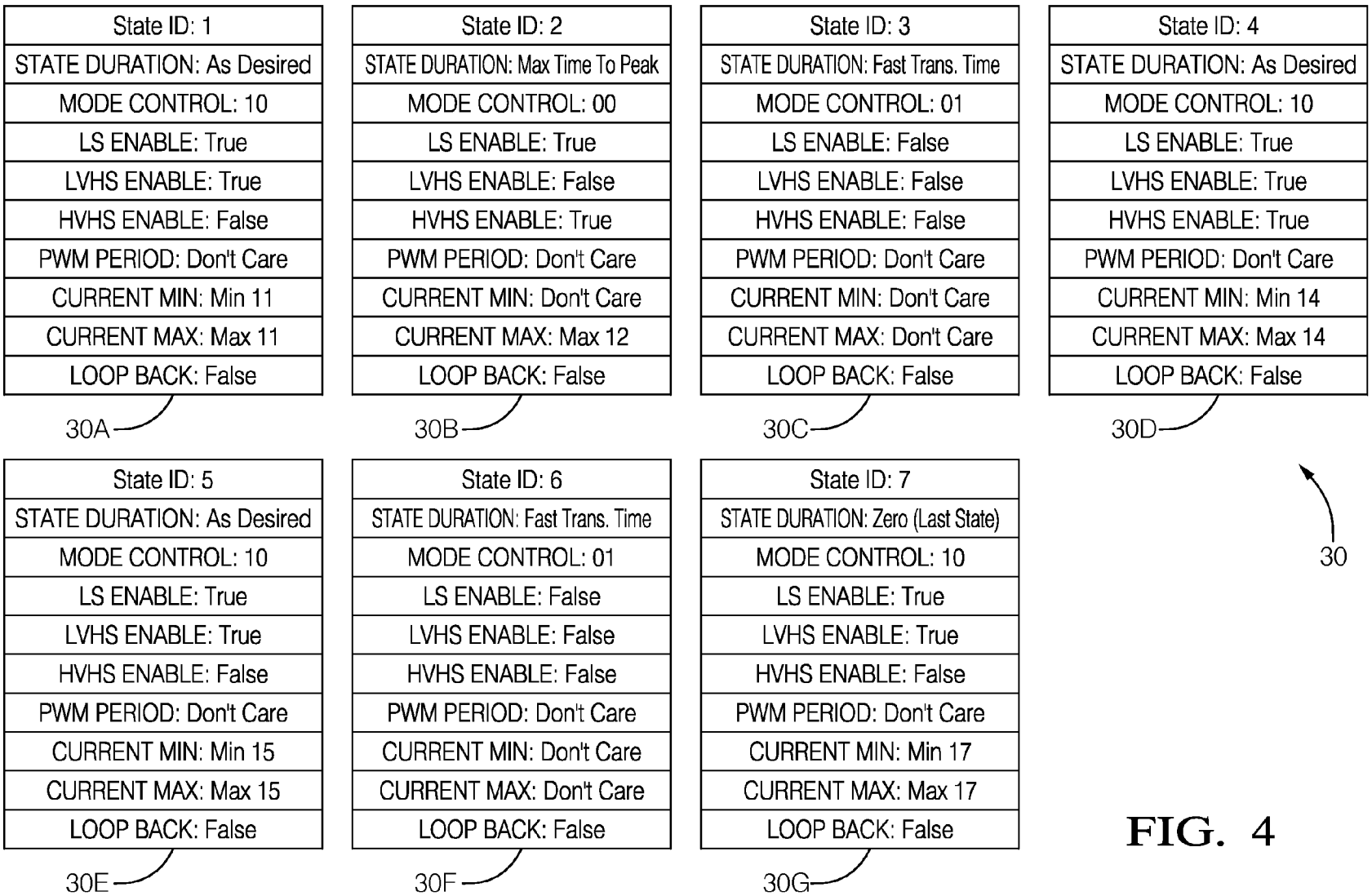
FIG. 4 is table of state definitions used in the system of FIG. 1 in accordance with one embodiment.

FIGS. 3 and 4 illustrate non-limiting examples of a generic state definition, and a plurality of exemplary state definitions 30 corresponding to the state definitions 30 shown in FIG. 2, respectively. In this non-limiting example, the generic state definition shown in FIG. 3 is forty-eight bits plus five bits for a state identification value. Ten variable values are indicated by the forty-eight-bit value. The following description of the variables is only for the purpose of explanation and not limitation. It is recognized that the order of the variables could be rearranged, the number of bits for some of the values could be changed, some variables could be eliminated if reduced pulse generation flexibility was acceptable, and that other variables could be introduced to increase flexibility.

STATE DURATION is a sixteen-bit value that specifies the number of clock cycles the state definition (30A, 30B, 30C, 30D, 30E, 30F, and 30G) should last or persist before moving on to a subsequent state definition.

MODE CONTROL is a two-bit value that specifies the mode of operation of the state definition 30. A value of '00' determines the mode to be a single current event that terminates execution of the state definition when a specified current has been detected corresponding to a value indicated by CURRENT MAX or CURRENT MIN, depending on which of the switches 24 are enabled. The state definition 30B is an example of this where as shown in FIG. 2, the state definition 30B persists until the current value Max_I_2 is detected. A value of '01' determines the mode to be a single duration event that terminates when the state definition has executed for a time duration specified by STATE DURATION. State definitions 30C and 30F in FIG. 2 are examples of this mode. A value of '10' determines the mode to be a current chop mode where a voltage is applied to urge the current to increase until the current is greater than the value specified by CURRENT MAX and then the voltage is removed or reduced to allow the current to decrease until the current is less than the value specified by CURRENT MIN. State definitions 30A, 30D, 30E, and 30G in FIG. 2 are examples of this mode. A value of 11 determines the mode to be a pulse width modulation (PWM) mode where voltage is applied such that the current increases for a time duration specified by DUTY CYCLE, and then the voltage is removed or reduced such that the current decreases for a time duration specified by PERIOD minus DUTY CYCLE.

LS ENABLE is a one-bit value that specifies that the low side switch receiving signal LS should be enabled during the state definition.

LVHS ENABLE is a one-bit value that specifies that the low-voltage high side switch receiving the signal LVHS should be enabled during the state definition.

HVHS ENABLE is a one-bit value that specifies that the high-voltage high side switch receiving the signal HVHS should be enabled during the state definition.

PWM PERIOD is an eight-bit value that specifies a time-duration of a signal used to pulse-width-modulate (PWM) the injector driver 22. By way of example and not limitation, PWM PERIOD may correspond to one clock cycle, for example, one-hundred nanoseconds (100 ns) per bit, and so can indicate a time range of zero clock cycles (e.g. zero nanoseconds or 0 ns) to twenty-five-point-five microseconds (25.5 us).

CURRENT MIN is an eight-bit value that specifies a current value detected or indicated by the current sensor 26 that turns on the appropriate switch 24 in the injector driver 22 when the controller 25 is operating in a current limit mode. By way of example and not limitation, CURRENT MIN may correspond to zero-point-one Ampere (0.1 A) per bit, and so can indicate a current range of zero Ampere (0 A) to twenty-five-point-five Ampere (25.5 A). When enabling current mode chopping, CURRENT MIN specifies the low current threshold that enables either the high-voltage high side switch or the low-voltage high side switch depending on which is enabled in the state.

PWM DUTY CYCLE is an eight-bit value that specifies the portion (i.e.—a percent duty cycle) of the PWM PERIOD that the injector driver 22 applies the supply voltage LV or HV depending on which is enabled in the state.

CURRENT MAX is an eight-bit value that specifies a current value detected or indicated by the current sensor 26 that turns off the appropriate switch 24 in the injector driver 22 when the controller 25 is operating in a current limit mode. By way of example and not limitation, CURRENT MAX may correspond to zero-point-one Ampere (0.1 A) per bit and so can indicate a range of zero Ampere (0 A) to twenty-five-point-five Ampere (25.5 A). When current chopping, CURRENT MAX specifies the high current threshold that disables either: the high-voltage high side switch or the low-voltage high side switch depending on which is enabled in the state.

LOOP BACK is a three-bit value that specifies how many states to jump backwards at the end of the state. A value of '001' indicates to repeat the same state until the channel is commanded off. A value of '010' indicates to jump back to the state executed one state before the current state, etc.

In general, the state definitions 30 are determined prior to operating the injector driver 22 to generate an injector pulse 21 of the drive signal 20. Many state definitions may be defined and stored in the controller 25. By way of example and not limitation, there may be thirty-two state definitions stored in the controller 25. Then the ECU 18, or the controller 25, can generate piecewise the injector pulse 21 by retrieving each of the state definitions 30 in whatever order is desired. In the case where the ECU determines which, and in what order, the state definitions 30 are used to generate piecewise the injector pulse 21, the ECU 18 need only communicate a five-bit state value to indicate which of the thirty-two state definitions 30 is selected or desired.

Figure 5:
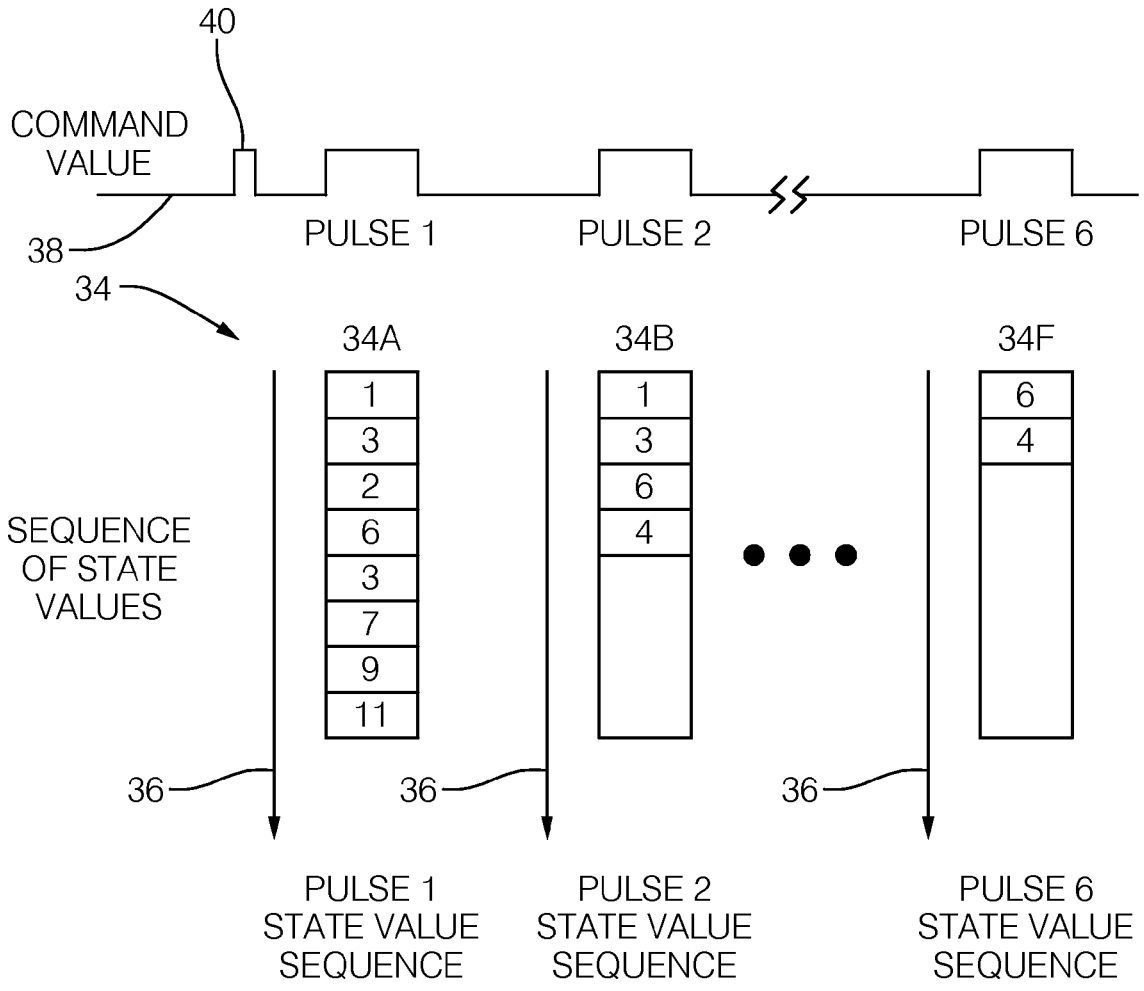
FIG. 5 is a table of sequences of state values specifying state definitions used in the system of FIG. 1 in accordance with one embodiment.

FIG. 5 illustrates a non-limiting example of a plurality of sequences of state values 34, for example Pulse 1 State Value Sequence 34A, Pulse 2 State Value Sequence 34B, and so on to Pulse 6 State Value Sequence 34F. In this example, the drive signal 20 is generated with six injector pulses, but it should be appreciated that a desired drive signal may include more or less than six injector pulses per combustion cycle of the engine 16. Each of the state value sequences (34A, 34B, . . . 34F) comprises a list or sequence of state values corresponding to the five-bit state ID or state values used to designate which of the thirty-two state definitions should be used. As suggested by the arrows 36, in this example the state value at the top of the state sequence is used to select the first state definition for operating the injector driver 22, followed by the next state value on the list, and so on to generate the injector pulse 21.

Accordingly, the controller 25 is configured to store a plurality of state definitions 30 that determine an operation state of the injector driver 22 when a selected state definition (State ID:1, State ID:2, State ID:3 . . . ) of the plurality of state definitions 30 is communicated to the injector driver 22. The controller 25 is further configured to receive a sequence of state values 34 (34A, 34B, . . . 34F) that determine an order that the state definitions 30 are communicated to the injector driver 22 to generate piecewise an injector pulse 21. The injector pulse 21 is generated based on state value sequences 34A, 34B, . . . 34F that produces a drive signal 20 that exhibits the pulse profile indicated by the injector current 27 and/or the injector voltage 28. It is also contemplated that the order of the sequences can be changed to generate various injector drive signals 20.

U.S. Pat. No. 7,647,919 to Moller et al. issued Jan. 19, 2010 describes a fuel injector controller that generates a drive signal using predefined injector pulse profiles stored in the fuel injector controller. However, each entire pulse is preprogrammed, and so the injector pulses generated by Moller are not generated piecewise. As such, Moller does not have the flexibility to make rapid or frequent changes to a pulse profile by simply selecting a different state definition 30 by receiving a different state value for use in a sequence of state values 34.

Referring again to FIG. 1, the ECU 18, the controller 25, and the injector driver 22 are illustrated as separate units only for simplifying the explanation of the system 10. By way of example and not limitation, the controller 25 may be a component 42 such as an integrated circuit that can be mounted on a circuit board within the ECU 18. Alternatively, the controller and the injector driver may be combined to form the component 42, or be assembled into a common housing (not shown) distinct from the ECU 18.

Referring again to FIGS. 2, 3, and 5, as described above, the state definition 30 selected includes a STATE DURATION value indicative of a time duration that the selected state definition is in effect. In one embodiment, when the time duration of a selected state duration (e.g. State ID:4 30D) has passed or expired, the controller 25 is further configured to communicate a subsequent state definition (e.g. State ID:5 30E) to the injector driver 22, or whatever is indicated by the sequence of state values. As indicated by the sequences of state values 34, the order that the state definitions 30 are communicated to the injector driver 22 is independent of (i.e. not dependent on) the order that the state definitions 30 are stored in the controller 25. Further flexibility is provided as the number of state values forming the sequence of state values 34 is variable, as illustrated in FIG. 5. This flexibility to customize an injector pulse by piecewise generation of the injector pulse allows for more precise and adaptive control of the fuel injector 12. As suggested in FIG. 5, six distinct injector pulses (Pulse 1-Pulse 6) may be generated to define the drive signal 20 for an engine cycle. As such, the order that state values (e.g. State ID:1, State ID:2, . . . ) within a sequence of state values (e.g. 34A, 34B, . . . ) is communicated to the injector driver 22 is independent of the order that the state definitions 30 are stored in the controller 25.

It may be desirable to allow the ECU 18 to determine the timing for initiating the generation of each distinct injector pulse (Pulse 1-Pulse 6), and so the controller 25 may be further configured to receive a command signal 38 (FIGS. 2 and 5) indicative of when to initiate each of the one or more injector pulses. The command signal 38 may also include a synchronization pulse 40, for example a one microsecond (1 us) pulse that initializes the controller 25 in preparation to receive subsequent injector pulse timing signals. This flexibility to customize an injector pulse timing of the drive signal 20 allows for more precise and adaptive control of the fuel injector 12.

In some instances, it may be desirable to operate one or more of the switches 24 in the injector driver 22 independently of the other switches. For example, it may be desirable to operate the low side switch (LS) to an ON state prior to operating one of the high side switches (LVHS, HVHS) in order to avoid generating electromagnetic emissions that may radiate and cause undesirable electromagnetic interference (EMI). As such, the state definitions 30 may include an operational state that operates any one or more of the switches 24 independently.

The controller 25 may include a processor such as a microprocessor or other control circuitry as should be evident to those in the art. The controller 25 may include memory, including non-volatile memory, such as electrically erasable programmable read-only memory (EEPROM) for storing one or more routines, thresholds, and captured data. The one or more routines may be executed by the processor to operate the injector driver 22 in accordance with signals received by the controller 25 for controlling the fuel injector 12 as described herein. Alternatively, the controller 25 may be equipped with a state machine instead of, or in addition to, a microprocessor.

Figure 6:
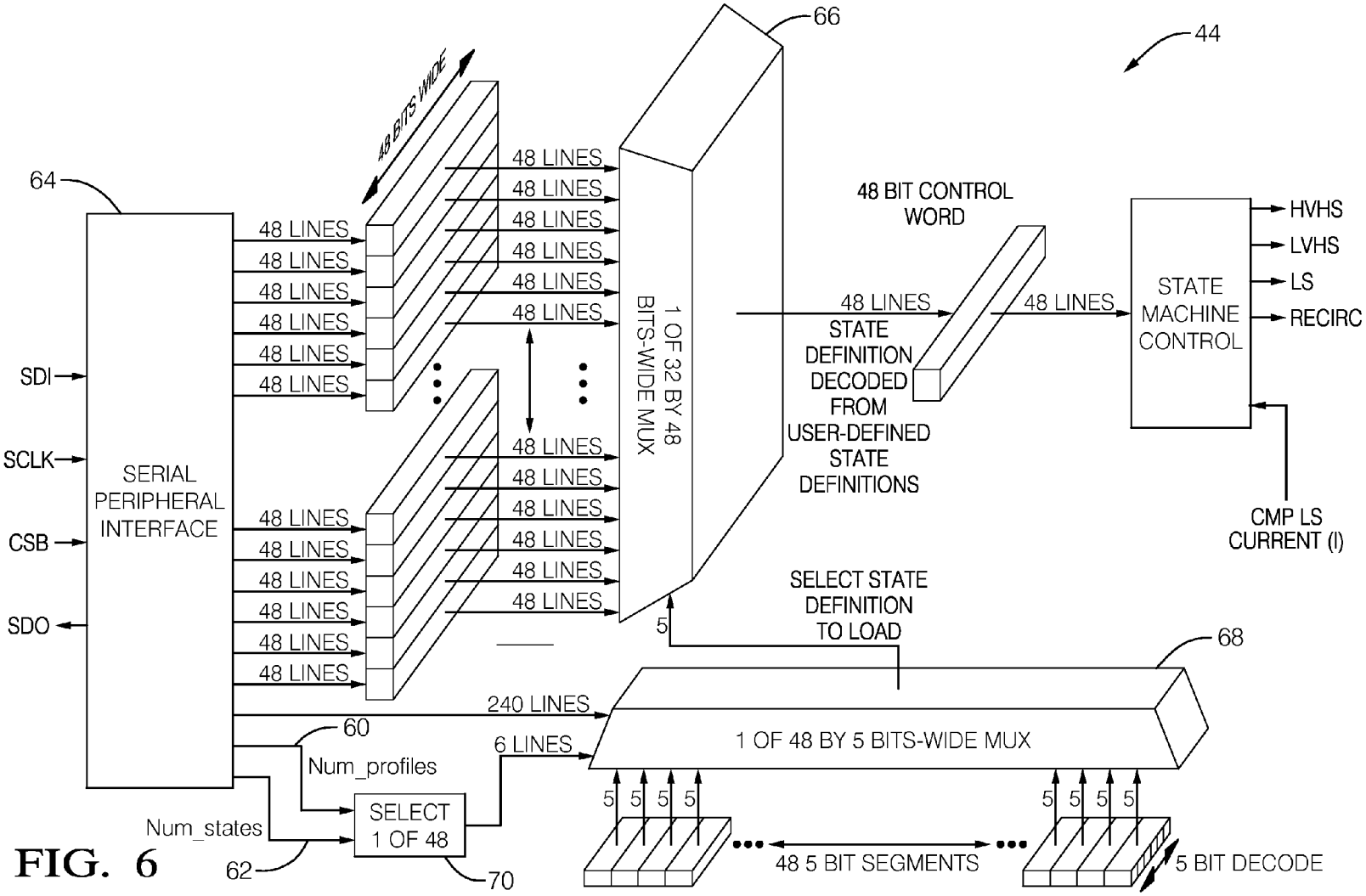
FIG. 6 is a diagram of a state machine used in the system of FIG. 1 in accordance with one embodiment.

FIG. 6 illustrates a non-limiting example of a state machine 44 suitable to be used as the controller 25 to operate the injector driver 22 based on the sequence of state values. The state machine 44 may store, for example, up to thirty-two state definitions 30, up to forty-eight state values (State ID:1, State ID:2, . . . ). The state machine 44 may also store, and control data such as the number of pulse profiles (Num_profiles) 60, which corresponds to the number of state value sequences 34; and the number of states (Num_states) 62, which corresponds to the number of state values in a state value sequence 34. For communication to the ECU 18, an industry standard Serial Peripheral Interface (SPI) 64 is used. FIG. 6 also shows a one-of-thirty-two state definition multiplexor 66, a one-of-forty-eight state selection multiplexor 68 and a state selection control block 70 labeled as 'Select one-of-forty-eight'.

Pulse profiles are created by sequencing state definitions 30 piecewise in the order specified in the sequences of state values 34. In the example shown, the parameters Num_states and Num_profiles are each four-bit values. A single pulse profile may consist of up to sixteen state definitions. Referring to FIG. 5, if the parameter Num_states equals eight, each state value sequence 34 can include up to eight state values. The first pulse profile will utilize the eight state values in state value sequence 34A to decode which of the thirty-two state definitions will be used to create the first injector pulse 21.

Note that the first pulse profile may be defined by less than eight state values. The second pulse profile will utilize the second group of eight state values in state value sequence 34B to create the second injector pulse 21. Within a pulse profile, a state executes for a duration determined by the state definition associated with that state. A state ends when the state has executed for the commanded duration or when the current specified in the state definition has been reached, depending on the MODE of operation of the state.

When the end of a state has been reached, the state selection control logic 70 (Select one-of-forty-eight) selects the next state value in the state value sequence and decodes the location of the next state definition to be used to continue to create the pulse profile. State values continue to be selected and executed until the number of state values specified by Num_states has been reached or the STATE DURATION value equals zero. Each additional pulse in the command signal 38 will cause the state selection control logic (Select one-of-forty-eight) to utilize the next state value sequence 34 until the number of pulse profiles as specified by Num_profiles has been reached. When the number of pulse profiles has been reached, the next command signal 38 will use the first state value sequence 34A, or will continue to use the last state value sequence 34. Alternatively, a synch pulse 40 can be used to cause the state machine to wrap to the first state value sequence 34A.

Accordingly, a system 10, and a component 42 for generating a drive signal suitable to operate a fuel injector is provided. The system 10 and component 42 uses state definitions 30 that define the voltages and currents needed for a particular part (i.e. the injector pulse 21) of a solenoid control waveform (i.e. the drive signal 20). The state definitions 30 can be combined in any order to create easily a wide variety of complex waveforms. When parameter changes are needed, this state-based approach reduces the data bandwidth required since each state can be updated independently. In addition, specific enable fields for all control switches (e.g. transistors) are defined in the state definitions 30 that further increase flexibility. For a fuel injector 12 and/or an engine 16 that require more than one injector pulse (e.g. the injector pulse 21) per cylinder event, the state definitions 30 specific to each injector pulse can be predefined and stored in the controller 25 such that the ECU 18 does not have to update waveform parameters between pulses. A synchronization pulse 40 may be used to specify the start of the cylinder event, which reduces communication throughput and timing requirements between the ECU 18 and the controller 25. The state definitions 30 include provisions for both current limit and duty-cycle control of the injector pulse 21, as well as a variety of current control modes.

While this invention has been described in terms of the preferred embodiments thereof, it is not intended to be so limited, but rather only to the extent set forth in the claims that follow.

We claim:

1. A system for generating a drive signal suitable to operate a fuel injector, said drive signal comprising one or more injector pulses, each injector pulse having a pulse profile, said system comprising:

an injector driver operable to apply a supply voltage to the fuel injector;

a controller configured to operate the injector driver in a manner effective to generate the drive signal, wherein said controller is configured to store a plurality of state definitions that determine an operation state of the injector driver when a selected definition of the plurality of state definitions is communicated to the injector driver, said controller further configured to receive a sequence of state values that determine an order that the state definitions are communicated to the injector driver to generate piecewise an injector pulse exhibiting the pulse profile, and thereby generate the drive signal.

2. The system in accordance with claim 1, wherein the selected state definition includes a state duration value indicative of a time duration that the selected state definition is in effect, wherein the controller is further configured to communicate a subsequent state definition to the injector driver when the time duration has expired or when a specified current level has been detected, wherein the subsequent state definition is indicated by the sequence of state values.

3. The system in accordance with claim 1, wherein one or more pulse profiles cooperate to define the drive signal for an engine cycle.

4. The system in accordance with claim 1, wherein the controller is further configured to receive a command signal indicative of when to initiate each of the one or more injector pulses.

5. The system in accordance with claim 1, wherein the controller comprises a state machine configured to operate the injector driver based on the sequence of state values.

6. The system in accordance with claim 1, wherein the injector driver comprises a plurality of switches configured to apply the supply voltage to the fuel injector, and the state definitions include an operational state that operates any one or more of the switches independently.

7. The system in accordance with claim 1, wherein a state definition comprises one or more of a state duration value, a minimum current value, a maximum current value, a pulse-width-modulation (PWM) period value, a PWM duty-cycle value, and a supply voltage selection value.

8. The system in accordance with claim 1, wherein the order that state values within a sequence of state values is communicated to the injector driver is independent of the order that the state definitions are stored in the controller.

9. The system in accordance with claim 1, wherein the number of state values forming the sequence of state values is variable.

10. An electrical component for operating an injector driver operable to apply a supply voltage to a fuel injector and generate a drive signal suitable to operate the fuel injector, said drive signal comprising one or more injector pulses, each injector pulse having a pulse profile, said component comprising:

a controller configured to operate the injector driver in a manner effective to generate the drive signal, wherein said controller is configured to store a plurality of state definitions that determine an operation state of the injector driver when a selected definition of the plurality of state definitions is communicated to the injector driver, said controller further configured to receive a sequence of state values that determine an order that the state definitions are communicated to the injector driver to generate piecewise an injector pulse exhibiting the pulse profile, and thereby generate the drive signal.

11. The component in accordance with claim 10, wherein the component further comprises the injector driver.

12. The component in accordance with claim 11, wherein the injector driver comprises a plurality of switches configured to apply the supply voltage to the fuel injector, and the state definitions include an operational state that operates any one or more of the switches independently.

13. The component in accordance with claim 10, wherein the selected state definition includes a state duration value indicative of a time duration that the selected state definition is in effect, wherein the controller is further configured to communicate a subsequent state definition to the injector driver when the time duration has expired or when a specified current level has been detected, wherein the subsequent state definition is indicated by the sequence of state values.

14. The component in accordance with claim 10, wherein one or more pulse profiles cooperate to define the drive signal for an engine cycle.

15. The component in accordance with claim 10, wherein the controller is further configured to receive a command signal indicative of when to initiate each of the one or more injector pulses.

16. The component in accordance with claim 10, wherein the controller comprises a state machine configured to operate the injector driver based on the sequence of state values.

17. The component in accordance with claim 10, wherein a state definition comprises one or more of a state duration value, a minimum current value, a maximum current value, a pulse-width-modulation (PWM) period value, a PWM duty-cycle value, and a supply voltage selection value.

18. The component in accordance with claim 10, wherein the order that state values within a sequence of state values is communicated to the injector driver is independent of the order that the state definitions are stored in the controller.

19. The component in accordance with claim 10, wherein the number of state values forming the sequence of state values is variable.

* * * * *